US007472668B2

(12) United States Patent
Lau

(10) Patent No.: US 7,472,668 B2
(45) Date of Patent: Jan. 6, 2009

(54) ANIMAL LITTER COLLECTOR

(75) Inventor: Tung Yan Lau, Hong Kong (HK)

(73) Assignee: Design Manufacture Limited, N.T. (HK)

( * ) Notice: Subject to any disclaimer, the term of this patent is extended or adjusted under 35 U.S.C. 154(b) by 301 days.

(21) Appl. No.: 11/217,608

(22) Filed: Sep. 2, 2005

(65) Prior Publication Data

US 2006/0260554 A1 Nov. 23, 2006

(30) Foreign Application Priority Data

Apr. 28, 2005 (CN) ..... 2005 2 0017329

(51) Int. Cl.
*A01K 29/00* (2006.01)

(52) U.S. Cl. ..... 119/867; 294/1.3

(58) Field of Classification Search ..... 119/867, 119/869, 161, 165, 166; 294/1.3, 1.4, 1.5; D30/162

See application file for complete search history.

(56) References Cited

U.S. PATENT DOCUMENTS 1,632,185 A * 6/1927 Jenner ..... 248/459
2,219,492 A * 10/1940 Prichap ..... 40/750
3,174,244 A * 3/1965 Walton ..... 40/774
D233,158 S * 10/1974 Lowe ..... D30/162
3,848,906 A * 11/1974 Fleishman ..... 294/1.3
3,917,333 A * 11/1975 Grattan ..... 294/1.3
3,971,503 A * 7/1976 Allan et al. ..... 294/1.3
3,986,744 A * 10/1976 Krogstad et al. ..... 294/1.3
4,132,442 A * 1/1979 Larsson ..... 294/1.3
4,138,153 A * 2/1979 Brown ..... 294/1.4
D257,406 S * 10/1980 Ouellette ..... D30/162
4,272,116 A * 6/1981 Tufte, Jr. ..... 294/1.3
4,343,105 A * 8/1982 Isaacson ..... 40/761
4,635,843 A * 1/1987 Tomlinson ..... 229/117.18
4,830,419 A * 5/1989 Watanabe ..... 294/1.3
4,836,594 A * 6/1989 Spreiter ..... 294/1.3
4,909,553 A * 3/1990 Hantover ..... 294/1.3
4,974,893 A * 12/1990 Grahn ..... 294/1.3
5,039,148 A * 8/1991 Brautovich ..... 294/1.3
5,054,828 A * 10/1991 Hantover ..... 294/1.3
5,186,384 A * 2/1993 Nelson ..... 229/122
5,439,101 A * 8/1995 Brink et al. ..... 206/45.24
D363,862 S * 11/1995 Lusignan ..... D8/10
5,535,940 A * 7/1996 Olds ..... 229/110
5,564,762 A * 10/1996 Ring ..... 294/1.3
5,678,339 A * 10/1997 Marventano ..... 40/789
5,711,564 A * 1/1998 Campbell ..... 294/1.3
5,865,486 A * 2/1999 Bussani ..... 294/1.3
5,878,461 A * 3/1999 Killian ..... 15/257.1
6,095,579 A * 8/2000 Nichols ..... 294/1.3
6,234,549 B1 * 5/2001 Brownell ..... 294/1.3

(Continued)

*Primary Examiner*—Yvonne R. Abbott

(57) ABSTRACT

The present invention relates to an animal litter collector comprising a flat board in oblong shape, the top end of which is disposed with a flap near the edge thereof; the flap and the flat board are integrally formed as one piece; one side of the flap which is closer to the middle part of the flat board is connected securely to the flat board, and the remaining sides of the flap are detached from the flat board; the flap can interlock with the flat board when it is folded downwards. The present invention is easy to store and convenient to carry. It is of simple structure and is ready for use without assembling. It is susceptible of lower production costs and can be used with used plastic bags of different sizes so as to reduce resource wastage.

10 Claims, 6 Drawing Sheets

U.S. PATENT DOCUMENTS 6,871,891 B2 * 3/2005 Rivera Garcia ..... 294/1.3
2005/0006914 A1 * 1/2005 Turner ..... 294/1.3
2005/0194799 A1 * 9/2005 Karimi et al. ..... 294/1.3

* cited by examiner

ANIMAL LITTER COLLECTOR

BACKGROUND OF THE INVENTION

The present invention relates to an animal litter collector and more particularly pertains to a portable animal litter collector for pet owners to clean up animal litter.

Keeping cats, dogs and other animals as pets has been common for a long time all over the world. Following the increase of the city population, the number of pets has also been increasing. Pet litter affects sanitary conditions and causes bad odors. Litter also makes places and shoes dirty and surrounding environments unpleasant. To prevent pet litter from being left in public areas, some countries even pass the laws -to punish the pet owners who allow pet litter leaving in public areas without cleaning it up. Therefore, cleaning up pet litter in a quick and effective manner is an important issue for pet owners.

To date, most pet owners use waste newspapers, magazines or plastic bags to clean up animal litter. Pet owners generally use the newspapers, magazines or plastic bags to pick up the litter by hand. Although the hands of the pet owners do not touch the litter directly, the acts are disgusting. Even if tools such as shovels are used to clean up the litter, it is still inconvenient and disgusting to clean up the tools after use unless the tools are disposable and -for one time use only. In view of these problems, some disposable animal litter removal devices are provided in the marketplace, but most of them require rather complicated folding or assembling before use. Some even have three-dimensional handles or supports which make them inconvenient to be carried around. Furthermore, the existing animal litter removal devices have paper or plastic bags or boxes attached or connected to them. The bags or boxes are of standard limited sizes. Using bags or boxes of the same size regardless of the sizes of the litters is indeed a waste of resources. In fact, the existing animal litter removal devices are of complicated structure and this increases the production costs and makes the devices too expensive for the majority of pet owners to afford. Accordingly, pet owners have been looking forward to a device which is susceptible of low production costs-and of-low prices of sale and which is portable and can dispose of animal litter quickly and effectively.

BRIEF SUMMARY OF THE INVENTION

In view of the aforesaid disadvantages now present in the prior art, the object of the present invention is to provide an animal litter collector which is portable and of simple and practical structure. The present invention can be used together with used plastic bags of different sizes so as to reduce resource wastage, lower the production costs and decrease the selling prices.

To attain this, the present invention generally comprises a flat board in oblong shape, the top end of which is disposed with a flap near the edge thereof; the flap and the flat board are integrally formed as one piece; one side of the flap which is closer to the middle part of the flat board is connected securely to the flat board, and the remaining sides of the flap are detached from the flat board; the flap can interlock with the flat board when it is folded downwards.

The side of the flap which is connected securely to the flat board is provided with a pressed line thereon, thereby enabling the flap to be folded downwards conveniently.

The flat board has an opening near the middle part thereof; the top edge of the flap has a projecting member; the projecting member is a narrow and elongated protruding piece which is integrally formed with the flap or securely connected to the flap; the projecting member corresponds to the opening when the flap is folded downwards, and the projecting member removably interlocks with the opening.

The flat board has an opening near the middle part thereof; the top edge of the flap has a projecting member; the projecting member is a narrow and elongated protruding part which is integrally formed with the flap; the side of the projecting member which is connected to the flap is provided with a pressed line, and the projecting member corresponds to the opening when the flap is folded downwards, and the projecting member removably interlocks with the opening.

The flap has an opening near the top edge thereof; the flat board has a projecting member near to the middle part thereof; the projecting member is a narrow and elongated protruding piece which is integrally formed with the flat board or securely connected to the flat board; the opening corresponds to the projecting member when the flap is folded downwards, and the projecting member removably interlocks with the opening.

The flap has an opening near the top edge thereof; the flat board has a projecting member near to the middle part thereof; the projecting member is a narrow and elongated protruding piece; the projecting member is integrally formed with the flat board, and one side of the projecting member is connected securely to the flat board, and the remaining sides are detached from the flat board, and the projecting member removably folds up; the opening corresponds to the projecting member when the flap is folded downwards, and the projecting member removably interlocks with the opening.

The other end of the flat board has another opening, the position of which corresponds to that of the projecting member when the flap is not folded downwards, and the shape and size of which correspond to those of the projecting member; the projecting member removably interlocks with the opening when the flat board is folded in half.

The opening is narrow in the middle for interlocking with the projecting member securely.

The edge of the other end of the flat board is slanted or toothed for ease of shoveling up animal litter.

The bottom of the flat board is disposed with a plurality of perforations for removing excess grass, sand or stones when shoveling up animal litter on grass or sand.

The middle part of the flat board is provided with a pressed line thereon for ease of folding up the flat board in half for storage.

The flat board is provided with two curved pressed lines; the curved pressed lines extend respectively from the bottom left and right corners of the flat board to the top middle part of the flat board, thereby enabling the two sides of the flat board to be fold up to form a shovel and providing the two folded sides for the user to hold the present invention with ease and preventing animal litter from dropping out of the flat board.

The present invention operates in the following way: When the user carries the present invention, as the present invention is an elongated flat board which occupies little space, it is therefore convenient to carry. With respect to the embodiments of the present invention which can be folded in half, the projecting member can removably interlock with the opening so as to securely fold up the flat board. It therefore occupies even less space and can be carried in the user's pocket. To use the present invention, the user first unfolds the flat board. The flap is then folded downwards forming a hole which serves as a handle for the user. The user may fold up the two sides of the flat board along the two curved pressed lines and holds the folded sides by hand. The user then uses the bottom end of the flat board to shovel up animal litter and put the flat board together with the animal litter thereon into a plastic bag of appropriate size as prepared. If the two sides of the flat board are folded up to form folded sides, the user may first press the folded sides along the two curved pressed lines to become flat before putting the flat board into the plastic bag. The user then folds the flap downwards so as to clip the opening edges of the plastic bag and to interlock with the flat board. The user can then dispose of the whole thing into a rubbish bin.

Comparing with the prior art, the present invention has the following advantages and effects:

First, the present invention is an elongated flat board which is easy to store and convenient to carry. It is of simple structure and is ready for use without assembling. It therefore overcomes the drawbacks of the prior art of being inconvenient to be carried and of requiring assembling before use. The present invention provides pet owners with a device to clean up animal litter conveniently and quickly while walking their pets outside.

Secondly, the present invention is made of recycle industrial plastic materials. In addition, its simple structure effectively reduces the production costs. As a result, even the present invention is disposable for one time use only, the selling prices can still be affordable to a majority of pet owners, thereby overcoming the disadvantage of high selling prices of the prior art.

The present invention can be used in combination with used plastic bags. Pet owners can also prepare plastic bags-of appropriate sizes depending on the usual sizes of the litter of their pets. It can therefore reduce resource wastage and help to improve environmental conditions. The disadvantage of the prior art of providing brand new bags or boxes of uniform size can thus be overcome.

DETAILED DESCRIPTION OF THE INVENTION

The preferred embodiments of present invention are further described in detail by means of the following embodiments and the accompanying drawings, which should not be regarded as limiting.

As illustrated in FIGS. 1 to 4, the first embodiment comprises a plastic flat board 1 in oblong shape, the top end of which is disposed with a flap 3 near the edge thereof. The flap 3 and the flat board 1 are integrally formed as one piece. While the flap 3 of the present embodiment is in the shape of a rectangle, it can be of different shape in other embodiment. The side of the flap 3 which is closer to the middle part of the flat board 1 is connected securely to the flat board 1 and the remaining three sides are detached from the flat board 1.

In the present embodiment, the top edge of the flap 3 has a projecting member 4. The projecting member 4 is a narrow and elongated protruding piece which is integrally formed with the flap 3. The projecting member 4 may be securely connected to the flap 3 in other embodiments. The flat board 1 is disposed with an opening 2 near the middle part thereof. The opening 2 is narrow in the middle for interlocking with the projecting member 4. The opening 2 may be of different shape in other embodiments. When the flap 3 is folded downwards, the projecting member 4 corresponds to the opening 2 so that the projecting member 4 removably interlocks with the opening 2.

Figure 1:
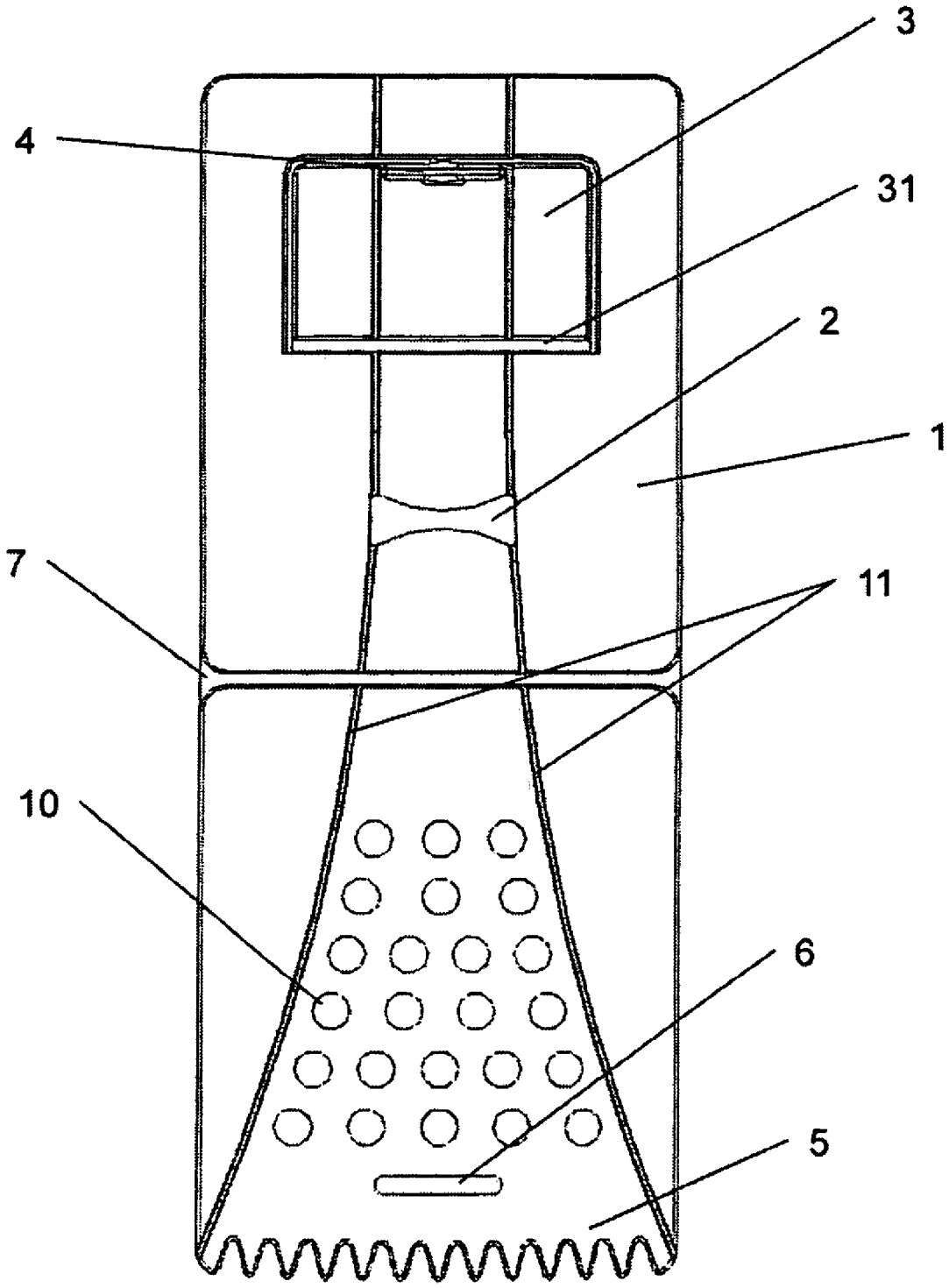
FIG. 1 shows the plan view of the first embodiment of the present invention.
Figure 2:
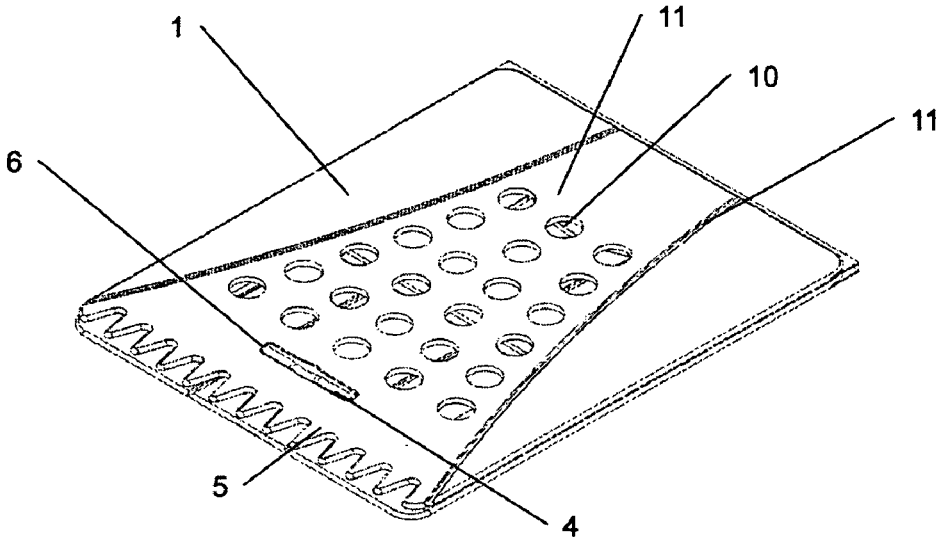
FIG. 2 shows the first embodiment of the present invention when it is folded.
Figure 3:
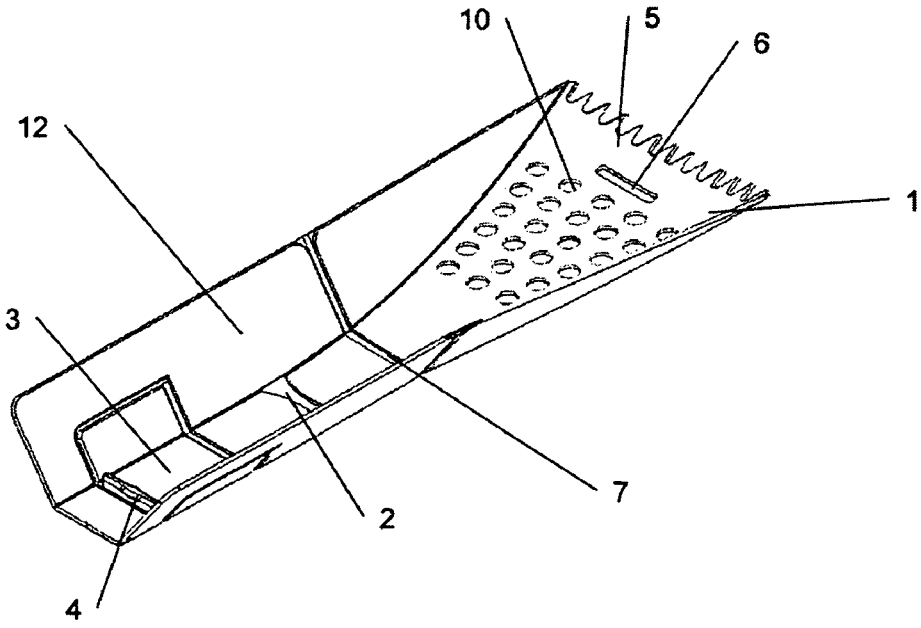
FIG. 3 shows the first embodiment of the present invention when the pressed lines on both sides are folded up to form a shovel.
Figure 4:
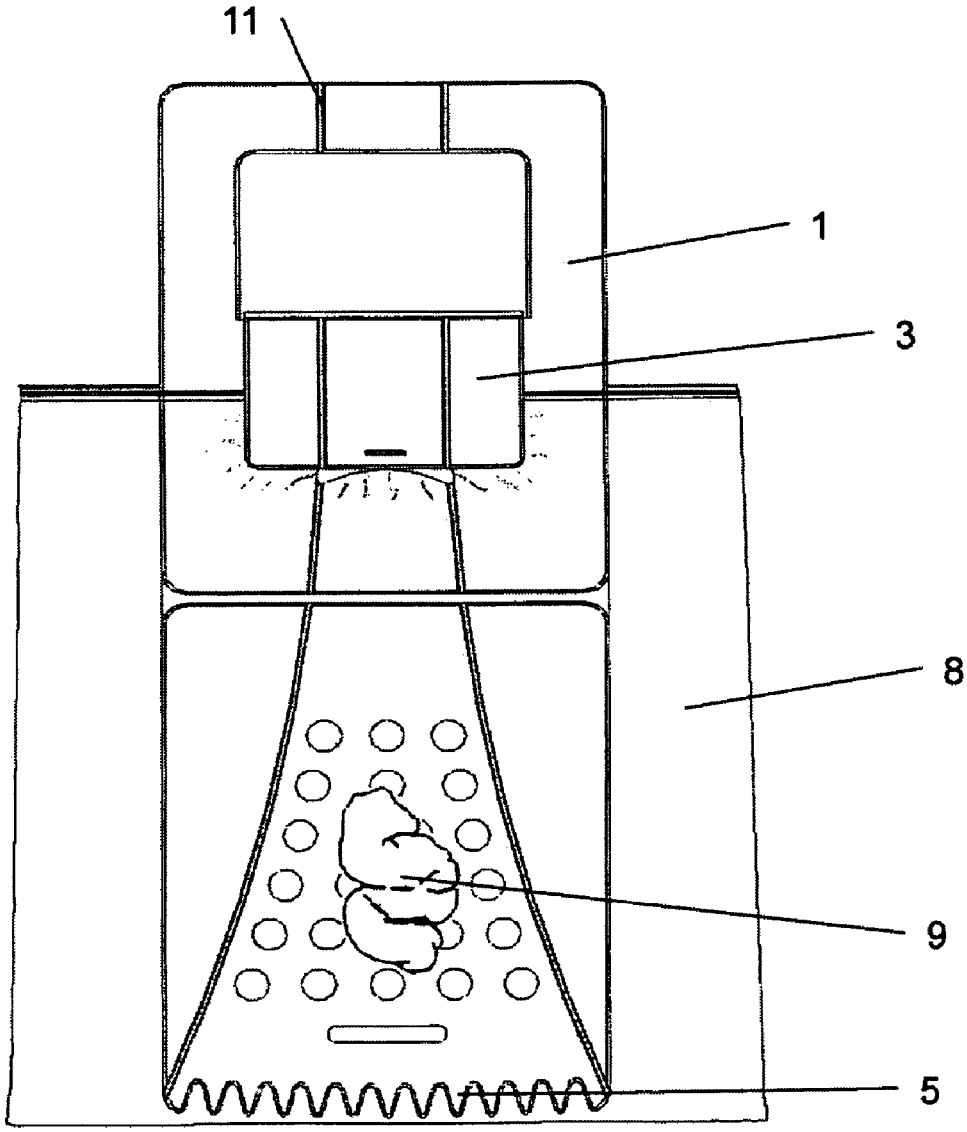
FIG. 4 shows the first embodiment of the present invention when it is being used.

In the present embodiment, the side of the flap 3 which is closer to the opening 2 is connected securely to the flat board 1 and is provided with a pressed line 31 thereon for ease of folding the flap 3 downwards. The middle part of the flat board 1 is provided with a second pressed line 7 thereon for ease of folding up the flat board 1 in half for storage. The other end of the flat board 1 is disposed with a second opening 6, the position of which corresponds to that of the projecting member 4 when the flap 3 is not folded downwards. The shape and size of the second opening 6 correspond to those of the projecting member 4. When the flat board 1 is folded in half for storage, the projecting member 4 removably interlocks with the second opening 6 for ease of storage and carrying, as illustrated in FIG. 2. The flat board 1 is provided with two curved pressed lines 11. The curved pressed lines 11 extend respectively from the bottom left and right corners of the flat board to the top middle part of the flat board 1, thereby enabling the two sides of the flat board 1 to be fold up to form a shovel and providing the two folded sides 12 for the user to hold the present invention with ease and preventing animal litter from dropping out of the flat board 1, as illustrated in FIG. 3. The bottom of the flat board 1 is disposed with a plurality of perforations 10 with a diameter of approximately 0.5 cm each for removing excess grass, sand or stones when shoveling up animal litter on grass or sand. The edge of the other end of the flat board 1 is a toothed edge 5. It can be a slanted edge in other embodiments. It facilitates shoveling up animal lifter 9 and putting into a plastic bag 8 of appropriate size as prepared by the user, as illustrated in FIG. 4.

Figure 5:
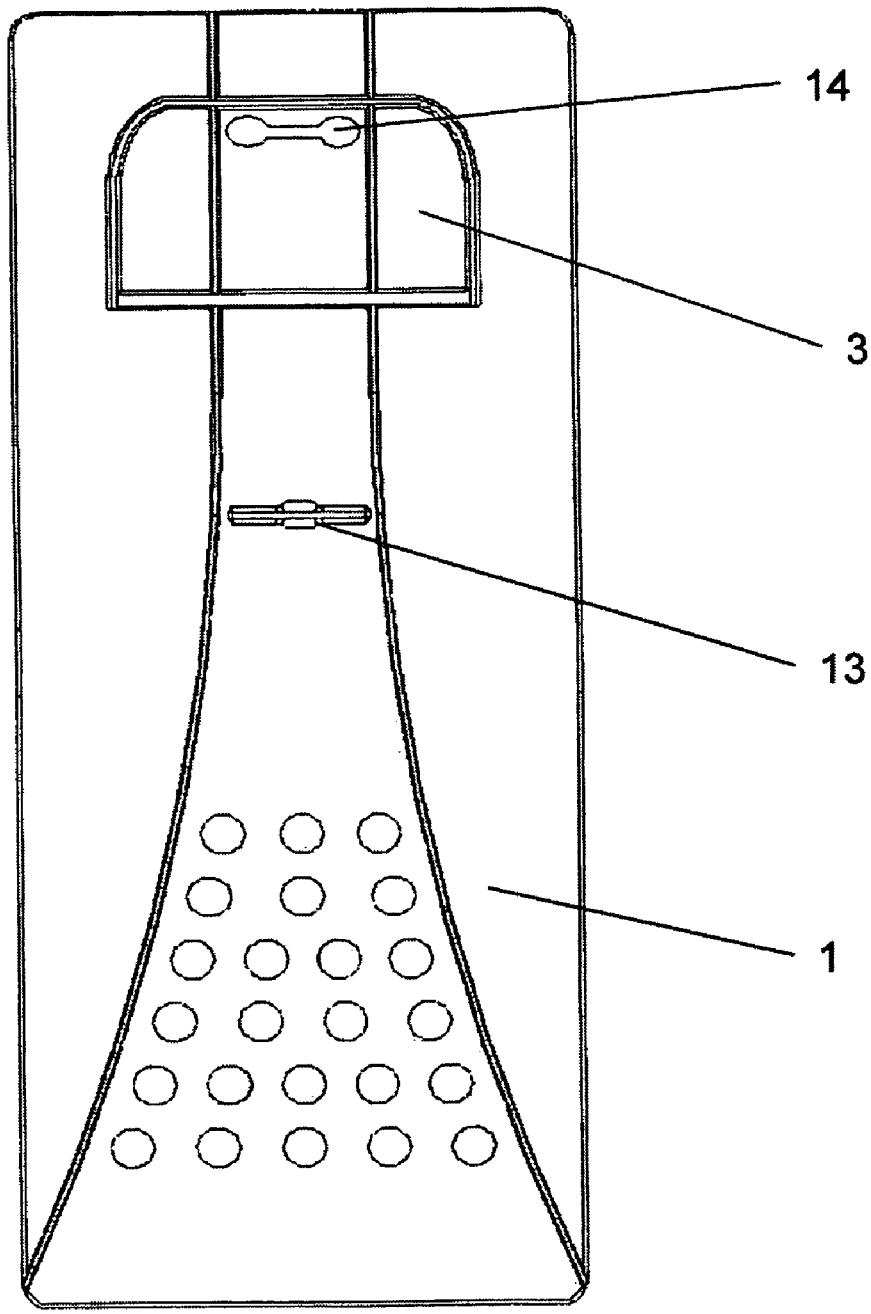
FIG. 5 shows the plan view of the second embodiment of the present invention.

FIG. 5 illustrates the second embodiment of the present invention. The second embodiment is similar in structure to the first embodiment as illustrated in that they both comprise a flat board 1 and a flap 3 which are integrally formed as one piece. However, the flap 3 is disposed with an opening 14 near the top edge thereof and the flat board 1 is disposed with a projecting member 13 near to the middle part thereof. The projecting member 13 is a narrow and elongated protruding piece which is integrally formed with the flat board 1 in the present embodiment. It can be securely connected to the flat board 1 in other embodiments. When the flap 3 is folded downwards, the opening 14 corresponds to the projecting member 13 and the projecting member 13 removably interlocks with the opening 14. Other parts of the structure of the present embodiment are similar to those of the first embodiment and are therefore not repeated here.

Figure 6:
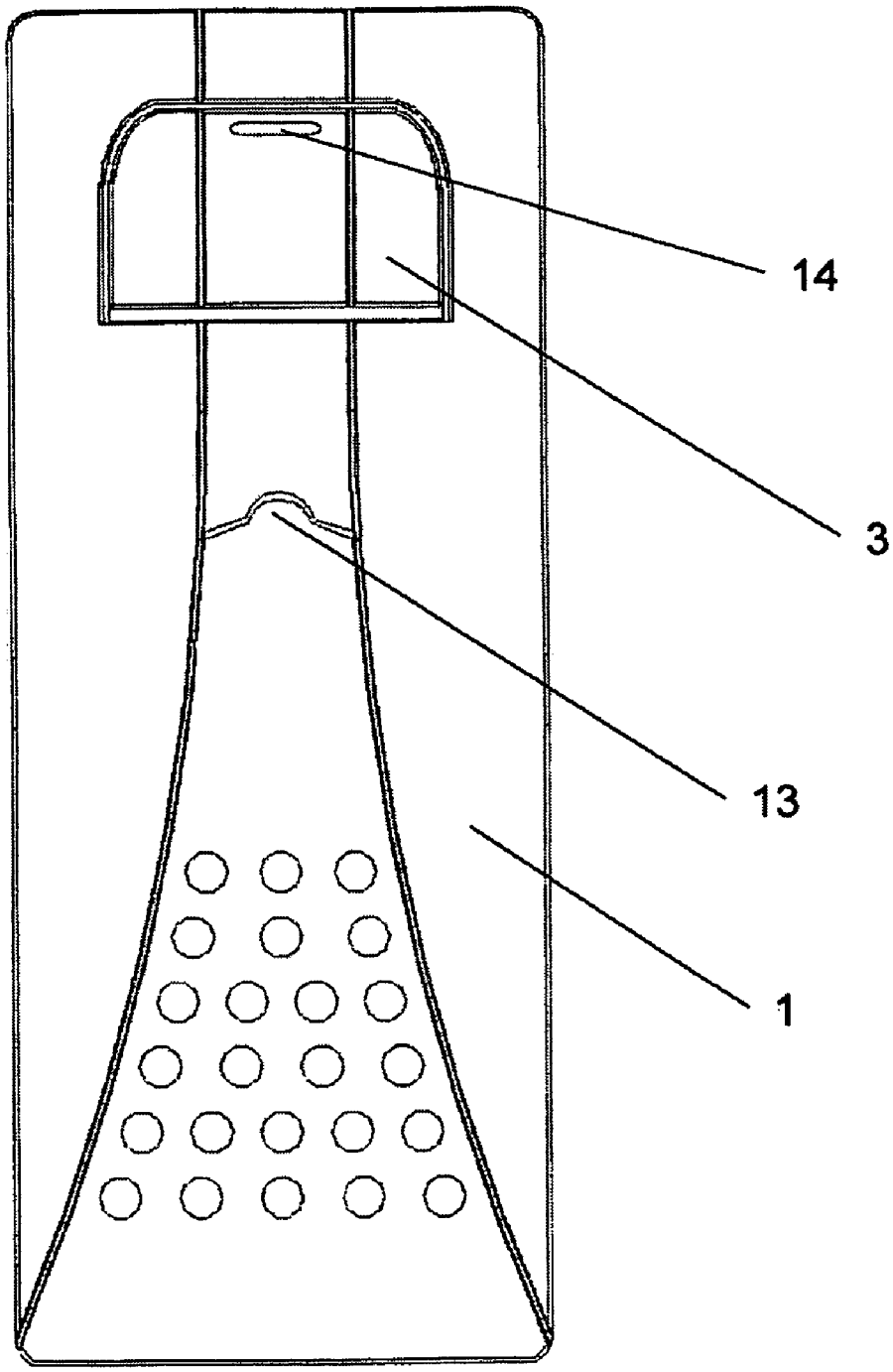
FIG. 6 shows the plan view of the third embodiment of the present invention.

FIG. 6 illustrates the third embodiment of the present invention. The third embodiment is substantially similar to the second embodiment. Similarly, the flap 3 is disposed with an opening 14 near the top edge thereof and the flat board 1 is disposed with a projecting member 13 near to the middle part thereof. The projecting member 13 is a narrow and elongated protruding piece, one side of the projecting member 13 is connected securely to the flat board 1, and the remaining sides are detached from the flat board 1, and the projecting member 13 removably folds up. When the flap 3 is folded downwards, the opening 14 corresponds to the projecting member 13 and the projecting member 13 removably interlocks with the opening 14. Other parts of the structure of the present embodiment are similar to those of the aforesaid embodiments and are therefore not repeated here.

Figure 7:
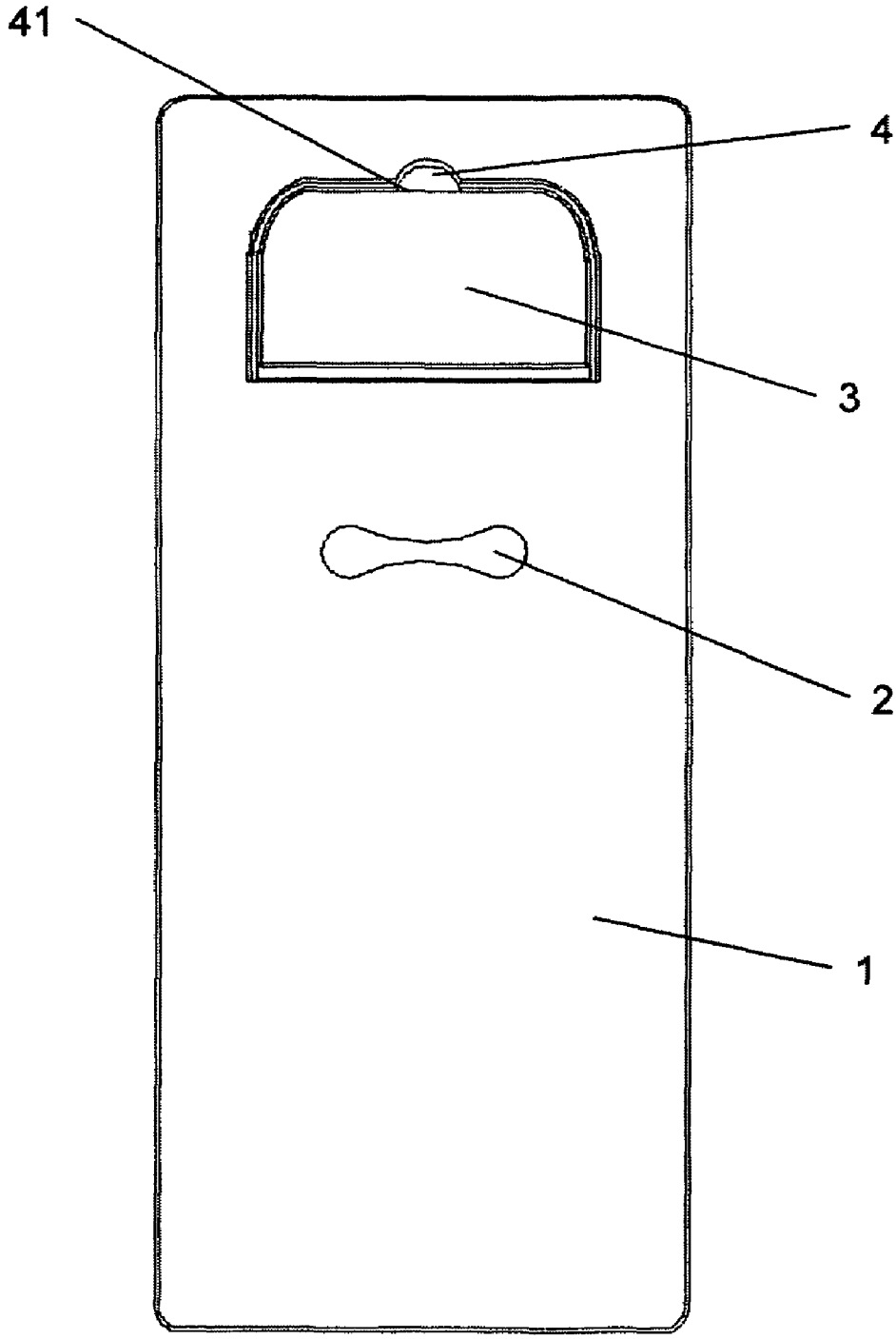
FIG. 7 shows the plan view of the fourth embodiment of the present invention.

FIG. 7 illustrates the fourth embodiment of the present invention. The fourth embodiment is substantially similar to the first embodiment in that they both comprise a flat board 1 and a flap 3 which are integrally formed as one piece. The flat board 1 is disposed with an opening 2 near the middle part thereof. The opening 2 is narrow in the middle. The top edge of the flap 3 has a projecting member 4. The projecting member 4 is a narrow and elongated protruding part which is integrally formed with the flap 3, and one of its sides which is connected to the flap 3 is provided with a pressed line 41 thereon. When the flap 3 is folded downwards, the projecting member 4 corresponds to the opening 2 and the projecting member 4 removably interlocks with the opening 2.

The present invention operates in the following way: When the user carries the second, third or fourth embodiment of the present invention, as the present invention is an elongated flat board 1 which occupies little space, it is therefore convenient to carry. With respect to the first embodiment of the present invention which can be folded in half, the projecting member 4 can removably interlock with the opening 6 so as to securely fold up the flat board 1. It therefore occupies even less space and can be carried in the user's pocket. To use the first embodiment of the present invention, the user first unfolds the flat board 1. To use the other embodiments, there is no need to unfold. The flap 3 is then folded downwards by hand to form a hole which serves as a handle for the user. In the first to the third embodiments which the curved pressed lines 11, the user may fold up the two sides of the flat board 1 along the two curved pressed lines 11 and holds the folded sides 12 by hand. The user then uses the bottom end of the flat board 1 to shovel up animal litter 9 and put the flat board 1 together with the animal litter .9 thereon into a plastic bag 8 of appropriate size as prepared. The user then folds the flap 3 downwards so as to clip the opening edges of the plastic bag 8 and to interlock with the flat board 1. The user can then dispose of the whole thing into a rubbish bin.

The above embodiments are preferred embodiments of the present invention. The present invention is capable of other embodiments and is not limited by the above embodiments. Any other variation, decoration, substitution, combination or simplification, whether in substance or in principle, not deviated from the spirit of the present invention, is replacement or substitution of equivalent effect-and falls within the scope of protection of the present invention.

What is claimed are:

1. An animal litter collector comprising a flat board in oblong shape, the top end of which is disposed with a flap near the edge thereof; the flap and the flat board are integrally formed as one piece; one side of the flap which is closer to the middle part of the flat board is connected securely to the flat board, and the remaining sides of the flap are detached from the flat board; when the flat board is placed into a plastic bag after collecting animal litter, the flap folds downward to clip the plastic bag's open edges and to interlock with the flat board to form a hole which serves as a handle for carrying the plastic bag filled with animal litter.

2. The animal litter collector as in claim 1, wherein the side of the flap which is connected securely to the flat board is provided with a pressed line thereon.

3. The animal litter collector as in claim 1, wherein the flat board has an opening near the middle part thereof; the top edge of the flap has a projecting member, the projecting member is a narrow and elongated protruding piece which is integrally formed with the flap or securely connected to the flap; the projecting member corresponds to the opening when the flap is folded downwards, and the projecting member removably interlocks with the opening.

4. The animal litter collector as in claim 1, wherein the flat board has an opening near the middle part thereof; the top edge of the flap has a projecting member; the projecting member is a narrow and elongated protruding part which is integrally formed with the flap; the side of the projecting member which is connected to the flap is provided with a pressed line, and the projecting member corresponds to the opening when the flap is folded downwards, and the projecting member removably interlocks with the opening.

5. The animal litter collector as in claim 3 or 4, wherein the other end of the flat board has another opening, the position of which corresponds to that of the projecting member when the flap is not folded downwards, and the shape and size of which correspond to those of the projecting member; the projecting member removably interlocks with the opening when the flat board is folded in half.

6. The animal litter collector as in claim 3 or 4, wherein the opening is narrow in the middle.

7. The animal litter collector as in claim 1, wherein the edge of the other end of the flat board is slanted or toothed.

8. The animal litter collector as in claim 1, wherein the bottom of the flat board is disposed with a plurality of perforations.

9. The animal litter collector as in claim 1, wherein the middle part of the flat board is provided with a pressed line thereon.

10. The animal litter collector as in claim 1, wherein the flat board is provided with two curved pressed lines; the curved pressed lines extend respectively from the bottom left and right corners of the flat board to the top middle part of the flat board.

* * * * *